United States Patent [19]

Maezawa

[11] Patent Number: 4,660,030

[45] Date of Patent: Apr. 21, 1987

[54] LIQUID CRYSTAL VIDEO DISPLAY DEVICE

[75] Inventor: Shuji Maezawa, Suwa, Japan

[73] Assignee: Seiko Epson Kabushiki Kaisha, Japan

[21] Appl. No.: 615,022

[22] Filed: May 29, 1984

[30] Foreign Application Priority Data

May 31, 1983 [JP] Japan ..... 58-96509

[51] Int. Cl.[4] ..... G09G 3/36

[52] U.S. Cl. ..... 340/784; 340/805

[58] Field of Search ..... 340/784, 789, 802, 805; 357/15, 45, 46

[56] References Cited

U.S. PATENT DOCUMENTS

| | | | |
|---|---|---|---|
| 4,233,603 | 11/1980 | Castelberry | 340/784 X |
| 4,346,378 | 8/1982 | Shanks | 340/784 X |
| 4,481,511 | 11/1984 | Hammura et al. | 340/784 X |
| 4,525,709 | 6/1985 | Hareng et al. | 340/784 X |
| 4,556,880 | 12/1985 | Hamada | 340/784 |

OTHER PUBLICATIONS

S. Morozumi et al., A 250×240 Element LCD Addressed by Lateral MIM, 1983, 404–406.

David R. Baraff et al., Application of Metal–Insulator–Metal Devices in Multiplexed Liquid Crystal Displays, 1980, 200–201.

*Primary Examiner*—Gerald L. Brigance

*Assistant Examiner*—Vincent P. Kovalick

*Attorney, Agent, or Firm*—Blum Kaplan Friedman Silberman & Beran

[57] ABSTRACT

This invention is directed to an improved liquid crystal video display device. An interlacing video display technique is utilized and scanning signals are provided to every other scanning electrode line in sequential order, shifting selected lines every frame. An additional selected voltage is provided during the time period which overlaps the selected scanning electrode lines to the adjacent non-selected electrodes both above and below the selected scanning electrode lines. According to the invention, a high resolution display is provided while reducing associated flicker by driving all scanning lines in the desired order.

13 Claims, 19 Drawing Figures

OSP
81
4.5MHz
82
COUNTER
IN
R
280
48
24
192
168
CRE
0
D
S
Q
CK
HSP
83
S
R
Q
84
85
RHP
QHP
DHP

VID
CRE
RHP
QHP
43
23
(288)
279

LIQUID CRYSTAL VIDEO DISPLAY DEVICE

BACKGROUND OF THE INVENTION

This invention relates generally to a liquid crystal display device and more particularly to a liquid crystal display device for use as a video receiver display device. Recently, the application of liquid crystal display devices to television or computer video receivers in place of CRT systems has been developing at a rapid pace. Liquid crystal display devices offer a number of potential advantages over CRT devices, namely lighter weight, thinner dimensions, reduced power consumption, low voltage operation and easier viewing because they are passive-type displays. However, a great number of picture elements are required to provide a liquid crytal display device. There have been a number of proposed driving methods for use with liquid crystal display panels used as video display devices for the purpose of driving these picture elements equally. Some of these driving methods include the active-matrix driving system utilizing Thin Film Transistors (TFT) and the like, a multiplex driving system utilizing high-duty liquid crystal material, and so on. Unfortunately, these conventional driving methods suffer from a number of defects. For example, in the Thin Film Transistor driving method, it is difficult to enlarge the area of display without degrading picture quality. The high-duty liquid crystal system material is not suitable for high-density displays.

Additionally, in the prior art, a liquid crystal display using non-linear elements is driven in the same manner as a standard cathode ray tube system. In this system, the video signal is created by using two scans which are interlaced. The scanning lines of a first field and a second field are combined as one scan, taking into account the characteristics and frequency of the alternating-current driving. This conventional method unfortunately still has problems of deterioration of quality of display, such as poor contrast, due to a low effective voltage and the appearance of flicker caused by a low driving frequency.

Therefore, a novel driving method which eliminates the above-noted difficulties in the conventional methods is desired. A "direct multiplex driving method" utilizing non-linear elements such as a Metal-Insulator-Metal (MIM) element has been developed which overcomes the aforenoted problems.

SUMMARY OF THE INVENTION

Generally speaking, in accordance with the invention, an improved liquid crystal video display device driving method is provided. The system utilizes a direct multiplex driving method utilizing non-linear elements such as a Metal-Insulator-Metal (MIM) element and a modified interlacing scanning method. A selected voltage is applied to every other scanning electrode line and shifted among said every other scanning electrode in sequential order during a scanning period, while another selected voltage which partly overlaps the scanning periods of the adjacent electrodes both above and below, is provided to the remaining scanning electrode lines. Video information is applied to signal electrodes aligned perpendicularly to the scanning electrodes during the period defined by defining the scanning period of a clock signal. A non-linear element is positioned at each intersection of a scanning and a signal electrode.

Accordingly, it is an object of the invention to provide an improved liquid crystal display device and driving method for use as a television display device.

Another object of the invention is to provide an improved liquid crystal display device and driving method for use as a television display device which provides a displayed image which is homogeneous.

A further object of the invention is to provide an improved liquid crystal display device and driving method for use in a liquid crystal television display, which utilizes simple driving circuits.

Still other objects and advantages of the invention will in part be obvious and will in part be apparent from the specification.

The invention accordingly comprises the features of construction, combination of elements and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

The non-linear element to which this invention pertains is of the type having non-linear characteristics exhibiting high resistance at a low applied voltage and low resistance at a high applied voltage. Such a non-linear element may be a varistor element, a Metal-Insulator-Metal (MIM) element, a diode element or a discharge tube element. It has been found that by providing a non-linear element of the above-noted type at each picture element of the display, the number of pixels which may be driven by a multiplex driving method increases substantially. The principle of multiplex driving is explained hereinafter in conjunction with the accompanying drawings.

Figure 1:
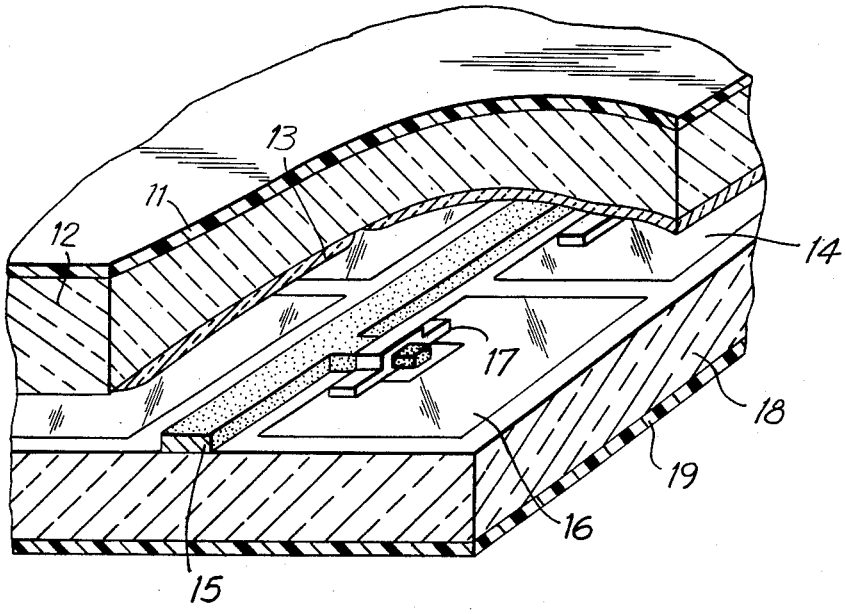
FIG. 1 shows a cross-sectional view of a conventional liquid crystal display device utilizing an MIM element in accordance with the invention.

Referring now to FIG. 1, an embodiment of the liquid crystal display device manufactured in accordance with this invention is shown wherein MIM elements are utilized at each pixel. The device of FIG. 1 contains an upper substrate 12, an upper polarizer 11 mounted to upper substrate 12, an upper substrate transparent electrode 13 affixed to upper substrate 12, a lower substrate 18, a lower polarizer 19 affixed to lower substrate 18, a picture element transparent electrode 16 affixed to lower substrate 18, a metal electrode with an oxidized surface 15 also affixed to lower substrate 18, a connecting metal electrode 17 for connecting the surface of metal electrode 15 to picture element transparent electrode 16, and a liquid crystal material 14 sandwiched between upper substrate 12 and lower substrate 18. An MIM element is provided at the connecting portion between the oxidized surface of metal electrode 15 and connecting metal electrode 17. In one embodiment, metal electrode 15 is made of tantalum.

Figure 2:
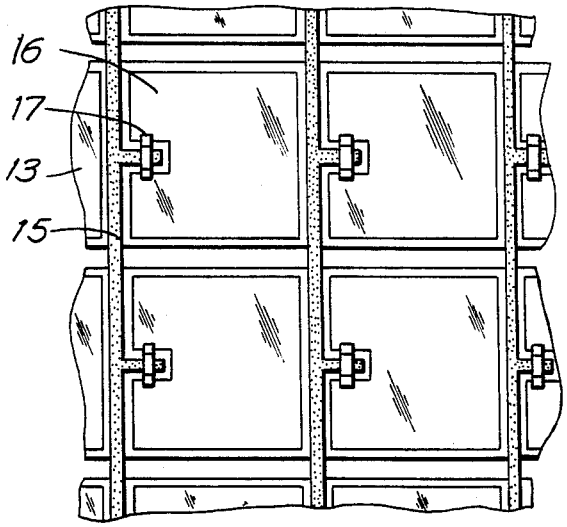
FIG. 2 is a fragmentary top plan view of an arrangement of picture elements in the liquid crystal display device of FIG. 1.

A fragmentary plan view of the liquid crystal display device of FIG. 1 is illustrated in FIG. 2. In FIG. 2, the upper substrate transparent electrode 13 is used as a scanning electrode, and metal electrode 15 and picture element transparent electrode 16 are used as signal electrodes. In this embodiment, the relationship of top and bottom and of right and left is freely interchangeable.

Figure 3:
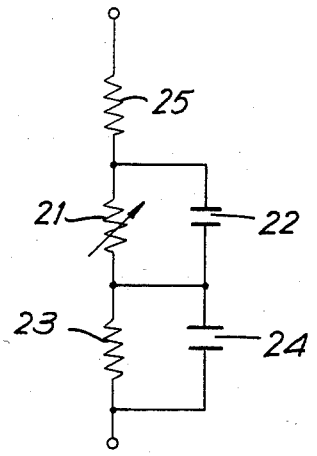
FIG. 3 is an equivalent circuit diagram of a picture element

Referring now to FIG. 3, an equivalent circuit diagram for one picture element, or pixel, is shown. The pixel represents one intersection of a scanning electrode and signal electrode of the liquid crystal embodiment shown in FIG. 1. A single picture element is shown in FIG. 3 and utilizes an equivalent resistor (RM) 21 and an equivalent capacitor (CM) 22 of a non-linear element, a resistor (RL) 23 and a capacitor (CL) 24, formed of a liquid crystal layer, and a wiring resistor (RK) 25 formed of wires connecting an electrode and the picture element. The resistance of resistor (RM) 12 of the non-linear element wires varies with the level of the voltage applied.

Figure 4:
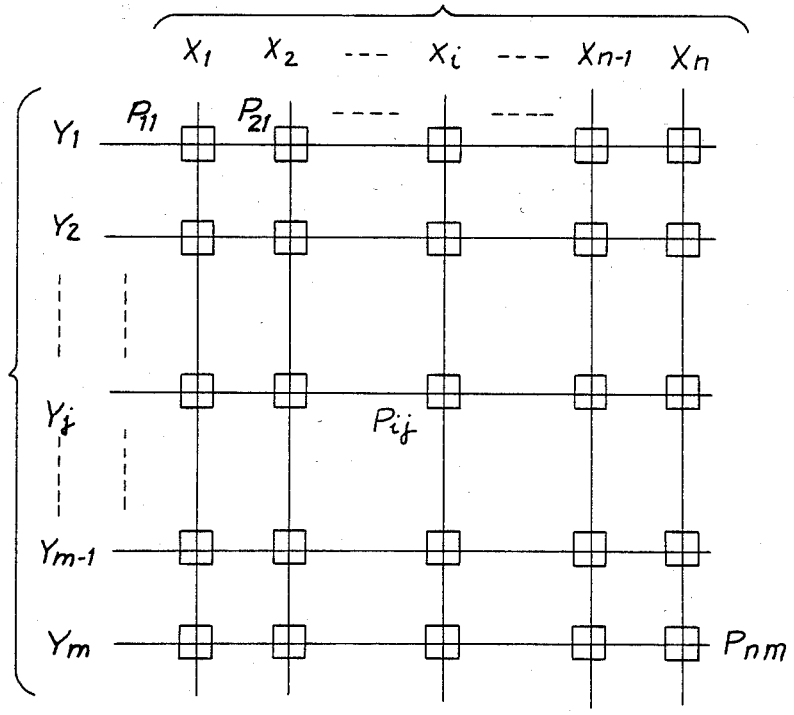
FIG. 4 is a graphic representation of an arrangement of picture elements and electrodes in a liquid crystal display device in accordance with the invention.

Referring now to FIG. 4, an arrangement of electrodes and picture elements of a liquid crystal display device made in accordance with the invention is shown. In FIG. 4, $X_1, X_2, \ldots, X_i, \ldots X_{n-1}$ represent signal electrodes, wherein n is the total number of electrodes, and i is one arbitrary electrode. Similarly, $Y_1, Y_2, \ldots, Y_j, \ldots : Y_{m-1}$ represent scanning electrodes, wherein m is the total number of electrodes, and j is one arbitrary. $P_{11}, P_{21}, \ldots P_{ij}, \ldots P_{n-1m}, P_{nm}$ represent each individual picture element, where the total number of pixels available is expressed by the equation $n \times m$.

Figure 5A:
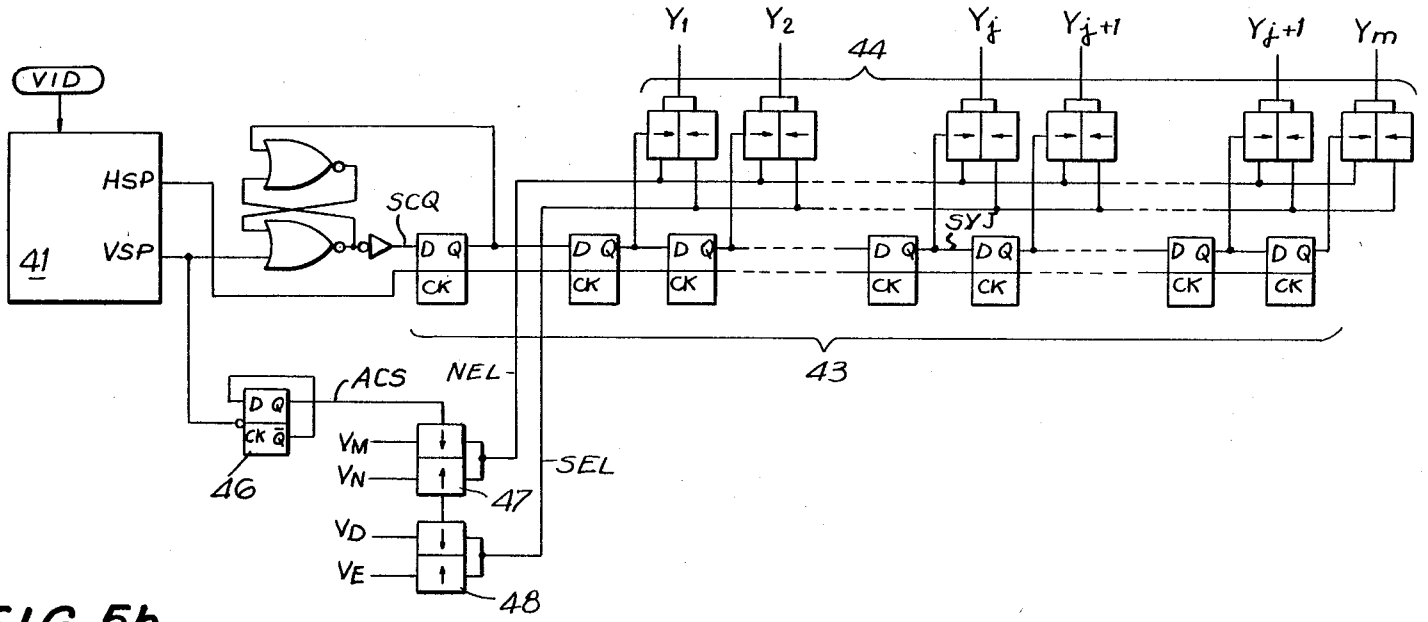
FIG. 5*a* is a schematic circuit diagram showing a scanning electrode signal generating circuit of the prior art.

Referring now to FIG. 5*a*, a circuit diagram in association with the scanning electrode signals provided to a conventional liquid crystal display device is shown. In this circuit, a composite video signal of a television is used as an input signal. The composite video signal VID is applied to a well-known synchronizing separator circuit 41 which delivers a horizontal synchronizing pulse signal HSP and a vertical synchronizing pulse signal VSP. It is noted that the vertical synchronizing pulse normally has a pulse width within the fly-back period.

The signal HSP is used as a clock signal to a multi-stage shift register 43. A signal SCQ, which is reset by an output of the first stage of multi-stage shift register 43 and which is set by signal VSP, is a data input to the multi-stage shift register 43. Each output of the multi-stage shift register defines the period of applying a selected voltage to each of the corresponding scanning electrodes. For example, each output of shift register 43, except for the first stage thereof, is a control signal to a corresponding dual analog switch group 44. The analog switch selects a non-selected voltage signal NEL or a selected voltage signal SEL as an output when the level of the control signal is a logic "0" or logic "1", respectively. These NEL or SEL signals are then utilized as the scanning electrode signals.

An inverted version of signal VSP is applied to a flip-flop 46 for use as a clock signal. Flip-flop 46 divides the inverted signal of signal VSP and outputs an alternating-current signal ACS. The alternating-current signal ACS is used as a control signal for controlling a pair of dual analog switches 47 and 48. These switches 47 and 48 output the aforementioned non-selected voltage signal NEL and the selected voltage signal SEL by switching over the non-selected voltage level of the first and second fields and by switching over the selected voltage of the first and second fields, respectively.

In the usual television scanning system, field frequency is 60 Hz, and 262.5 scanning lines are interlaced in a first field, with another 262.5 scanning lines being interlaced in the second field. A combination of first and second fields makes up a single frame.

Figure 5B:
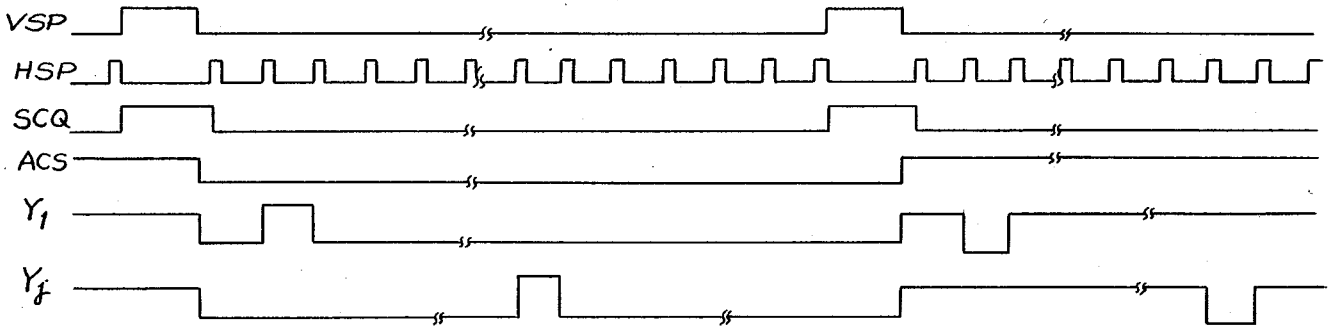
FIG. 5*b* is a timing sequence diagram of signals available in the circuit of FIG. 5*a;*

As shown in the conventional system of FIGS. 5*a* and 5*b*, one scanning period is equal to one selected period. Additionally, the scanning electrodes number somewhat less than 260. In actuality, as the scanning lines above and below the ends of the picture image are not actually utilized, the number of scanning electrodes required is approximately 240.

FIG. 5*b* illustrates the waveforms of the main signals used in the circuit illustrated in FIG. 5*a*. As can be seen, signals VSP, HSP, SCQ and ACS are two-level controlling signals, while the scanning electrode signals $Y_1$ and $Y_j$ are four-level control signals.

Figure 6:
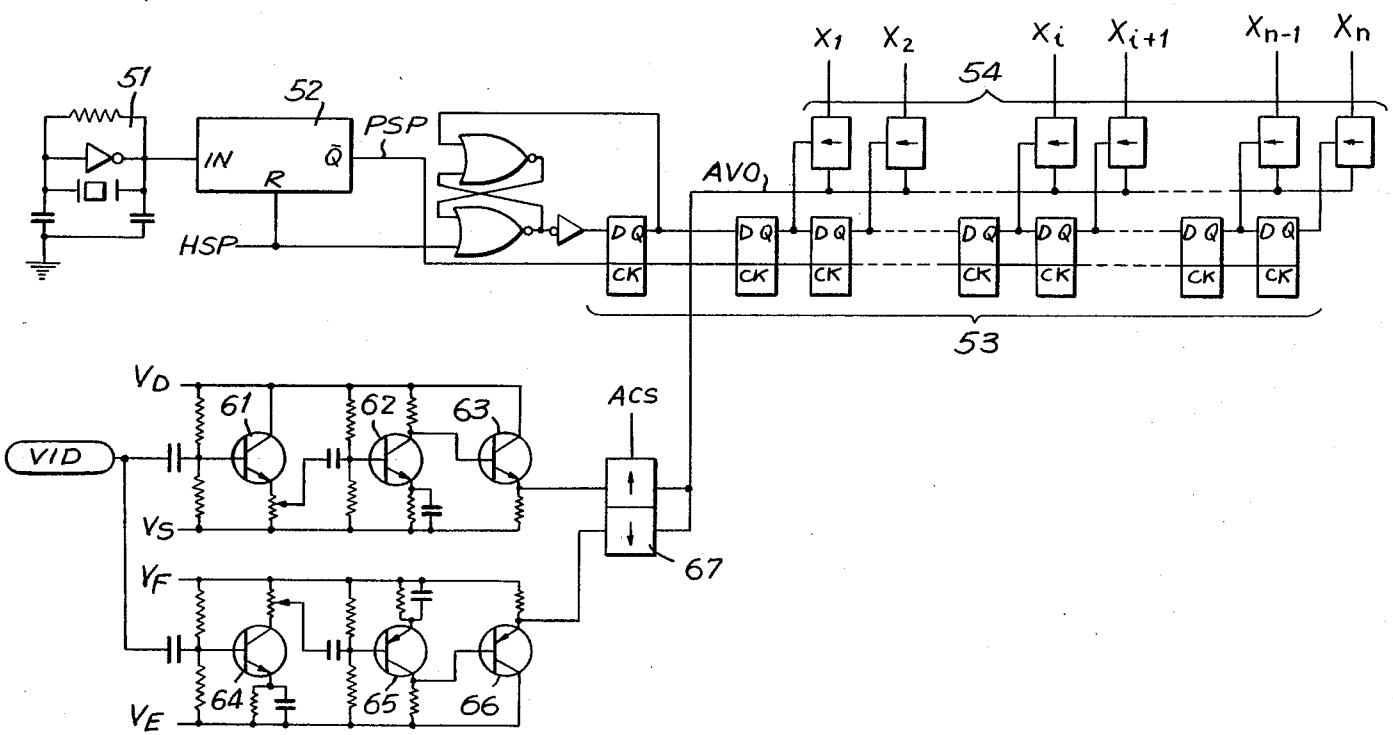
FIG. 6 is a schematic diagram of a circuit generating signal electrode signals of the prior art.

Referring now to FIG. 6, a circuit diagram of a conventional circuit for generating a signal electrode signal in the conventional liquid display device is shown. A signal having a frequency of between 8 and 12 MHz is produced by a well-known crystal oscillator 51. The oscillator signal is coupled to divider circuit 52 and is divided by two to four stages. The divider circuit outputs a clock signal PSP of between 2 and 6 MHz. Clock signal PSP is reset by a horizontal synchronizing pulse signal HSP. Clock signal PSP is input to the multi-stage shift register 53 so that the level of the output of multi-stage shift registers 53 becomes a logic "1" at regular intervals. A signal which is set by the horizontal synchronizing pulse signal HSP and reset by an output of the first stage of the multi-stage shift register 53 is used as a data input to the multi-stage shift register 53. In addition, each output of the multi-stage shift register acts as a control signal to a corresponding analog switch group 54, which in turn outputs a signal to each signal electrode $X_1$ to $X_n$, respectively. An input signal is provided to each analog switch group 54. The input signal is an alternating-current video signal AVO. The signal AVO is applied to the signal electrodes $X_1$ through $X_n$ for a short time.

Referring now to the lower portion of the circuit illustrated in FIG. 6, a circuit for forming the AVO signal is shown. The AVO signal is formed by switching between a negative video signal having a high voltage level and a positive video signal having a low voltage leval. The switching occurs through the control of alternating-current signal ACS to analog switch 67. The actual formation of the AVO signal is now described in detail.

The high voltage level component of a composite video signal VID, which passes through a capacitor 100, is input to the base of a transistor 61. Transistor 61 is configured into an emitter-follower-type circuit which amplifies the output current. At this point, the bias voltage level of the base input is defined appropriately to pick out the picture information contained in the composite video signal. This eliminates the synchronizing pulse found in the blanking period. The output of transistor 61 is modulated by a variable resistor 102 and is then applied to the base of transistor 62, which is configured in a grounded-emitter-type application. The output of transistor 62 is inverted and amplifies the input signal, providing an output at its collector. The output of transistor 62 is then amplified by transistor 63, configured in an emitter-follower application to finally output a negative video signal.

The low voltage level component of the composite video signal, on the other hand, passes through capacitor 101 and is input to the base of transistor 64, which outputs an inverted signal at its collector. Variable collector resistor 103 is appropriately adjusted to control the signal level, and the inverted output of transistor 64 is once again inverted and amplified through transistor 65. The output of transistor 65 is then input to transistor 66 and amplified into output to be a positive video signal.

Both the negative video signal output from transistor 63 and the positive video signal output from transistor 66 are coupled to analog switch 67. The alternating-current signal ACS is applied to analog switch 67 to switch between the two video signals in synchronicity with the scanning signals. In this way, analog switch 67 outputs an alternating video signal AVO which is used as an input to the analog switch group 54.

Referring now to FIGS. *7a, 7b* and *7c*, a set of equivalent circuits for explaining the principle of operation of a liquid crystal display utilizing MIM elements in accordance with this invention is shown. To aid in providing a simple explanation, a single arbitrary picture element is used as an example. Also, since the only difference between picture elements is the polarity applied between the first half and second half period of the alternating current applied to the picture element, and since this polarity change does not affect the performance of the picture element, the condition of alternating current is not considered in this explanation.

Referring now to FIG. *7a*, a circuit diagram of a single picture element to which a certain piece of picture information is about to be written is illustrated. The picture element of FIG. *7a* includes a capacitor of a non-linear element CM and an associated variable resistor RM, a capacitor of liquid crystal picture element CL and its associated resistor RL and the wire resistor RK. The symbols E and VL designate the picture output voltage level and the voltage applied to the liquid crystal picture element, respectively. If the clock signal PSP for writing to the picture element has a frequency of 3 MHz, then the writing period will be about $3\times10^{-7}$ seconds, during which time the switch in FIG. *7a* is closed. If we assume that capacitor CM and capacitor CL are not charged before the information is to be written to the picture element, then the voltage VL can be estimated by the formula:

$$VL = \frac{CM}{CL + CM} E$$

in which the time constants of the capacitors are compared.

Referring now to FIG. *7b*, an equivalent circuit of one picture element is shown wherein the analog switch is opened after information has been written. Once capacitors CM and CL of the picture element are charged, a charge CK is maintained on the signal electrode line even after the analog switch is opened; that is, the element is not being selected. Therefore, the signal electrode line will maintain a charge CK having a value which is the ame as the sum total of capacitance of the non-selected picture elements on the same signal electrode line. Since each signal electrode line has more than 200 picture elements, the charge CK of each signal electrode line is about 200 times as large as the capacitance of a single pixel. This charge held on the signal electrode line contributes to the process of writing information to the selected picture element. Since the state of the picture element illustrated in FIG. *7b* lasts for a long time compared to that with the state shown in FIG. *7a*, wiring resistor RK may be ignored for ease of explanation. As information is written to the picture element, the value of voltage VL applied to the liquid crystal picture element approaches the value of RL/(RL+RM). RM is a function of (E−VL); wherein as E becomes large, RM becomes small. Then, when VL becomes large and (E−VL) becomes small, RM becomes large. Consequently, RM maintains a balanced value which is equal to the value when the alteration of E is large. In this way, in order to obtain a value for RM which is closest to the balanced value, the time constant $\tau$ may be expressed by the following formula:

$$\tau = \frac{RL \cdot RM \cdot (CL + CM)}{RL + RM}$$

In other words, when E is large, RM becomes small and the time constant also becomes small. In this way, writing of information to the pixel is achieved in a rapid manner. Also, VL is the value when the alteration of E is large. In one example, during a single scanning period (1H), VL may be equal to 30% to 50% of E.

As noted above, a single scanning period 1H of a composite video signal is about $6.35\times10^{-5}$ seconds and is about the same order as the time constant $\tau$ of the capacitance of each picture element. The scanning period for picture elements on the left is about 1H, while the scanning period for picture elements on the right is at most 0.2H. In fact, however, picture elements on the right hold the information of the preceding scan during the first 0.8H of the scanning period, and a problem of poor contrast in the display does not normally occur in practice.

Figure 7A:
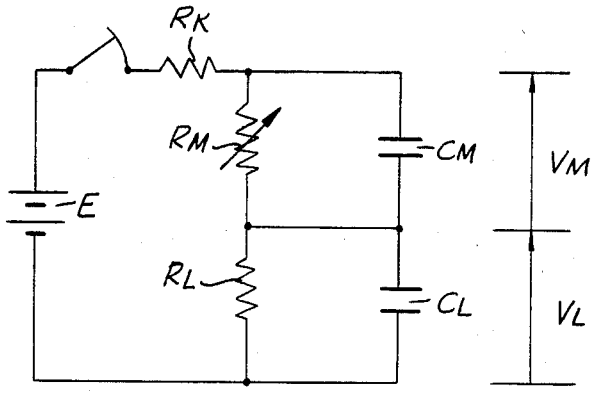
FIGS. 7*a,* 7*b* and 7*c* are schematic diagrams of circuit representations of the performance of a liquid crystal display device utilizing MIM elements.
Figure 7B:
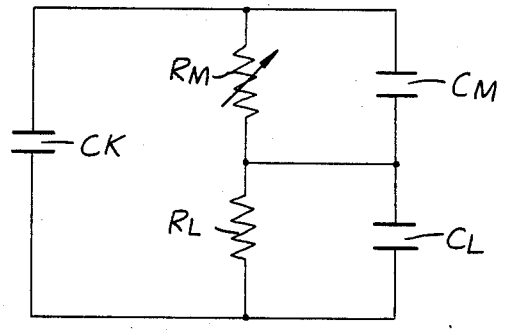
Figure 7C:
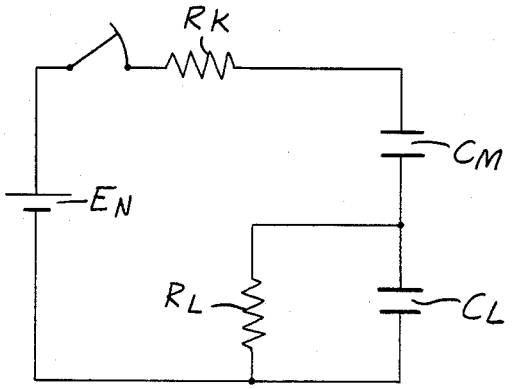

Referring now to FIG. *7c*, an equivalent circuit of a picture element to which information is about to be written just after the state shown in FIG. *7b* is illustrated. In FIG. *7c*, the resistor of non-linear element RM may be considered infinite in value compared with the value of the other elements. EN designates the writing voltage when the picture element switch is open. The voltage VL applied to the liquid crystal picture element in the state shown in FIG. 7*c* is expressed by the equation:

$$VL = VL(0) + \frac{CM}{CL + CM}(EN - E)$$

in which VL(0) is the value of VL at the end of the preceding selected period of the picture element. In general, the value of EN changes every time new information is written to the picture element. EN is defined by the expression EN(t), and the amount of change $\alpha E$ is expressed by the equation:

$$\alpha E = VL(0) - \frac{CM}{CL + CM} \cdot E$$

By using EN(t) and $\alpha E$, the following formula may be obtained:

$$VL(t) = \alpha\, E\exp - \left(\frac{t}{RL \cdot CL}\right) + \frac{CM}{CL + CM} EN(t)$$

in which t is the time from the beginning of the information writing period. The quality of contrast available at the liquid crystal display panel depends upon the effective value of VL(t) as obtained above.

Thus, the liquid crystal display device utilizing nonlinear elements, such as an MIM element, develops pictures as explained above. However, since the number of scanning lines used in the liquid crystal display device described so far is about half the number necessary for use in a CRT television system, the resolution of the liquid crystal display device is poor and not satisfactory as a minitor display. Yet, if the number of scanning lines provided is as many as those found in a CRT system, and those lines are interlaced in the same manner as that of the CRT system, that is, by the two-field-one-frame method, the following problem arises.

As known, each scanning electrode is selected once per two fields, i.e., one frame, and the period for writing information is decreased to a half of that noted previously. As a result, the effective voltage is lowered, and the quality of contrast of the display is deteriorated. In fact, even if a large driving voltage is applied to maintain fairly good contrast, the cycle of alternating driving of the field in two frames provides a driving frequency which may be as low as 15 Hz. Such a low driving frequency causes flicker of pictures and viewing of the image may become uncomfortable to the viewer.

Therefore, it is an object of this invention to eliminate the above-mentioned disadvantages and to provide an improved driving method for liquid crystal video receivers which provides sharp and clear pictures. In summary, scanning lines are interlaced in the manner in which one selected voltage is provided to every other scanning electrode during the scanning period, shifting in order by every other scanning line, and another selecting voltage is provided to the remaining scanning electrodes so that the period of providing this voltage to the electrode partly overlaps those of adjacent scanning electrodes both above and below. In each scanning period, the voltage applied to the scanning electrode goes to a selected level. The signal electrode driving signal is the same as that used in a conventional system. In the case where a two-field-one-frame interlace is to be performed, the scanning electrode which is in the scanning period in the first field and the scanning electrode which is in the scanning period in the second field are arranged to be in an alternate position. Also, a driving current is an alternating current whose polarity changes every field.

A detailed circuit structure made in accordance with this invention is now described.

Figure 8A:
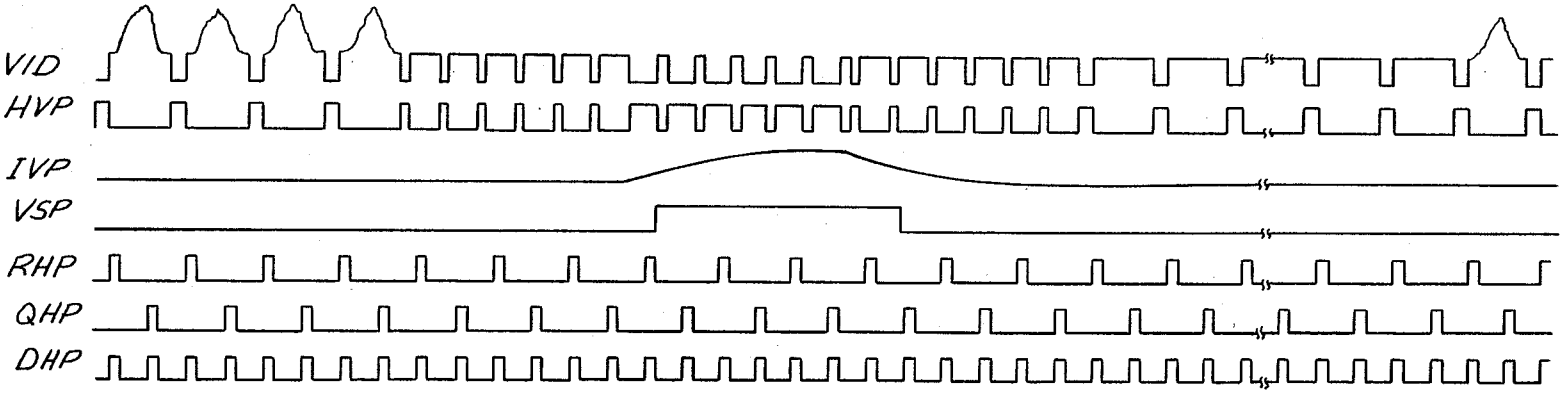
FIGS. 8*a* and 8*b* represent timing waveforms corresponding to the first field and second field of the video signal in accordance with the invention.
Figure 8B:
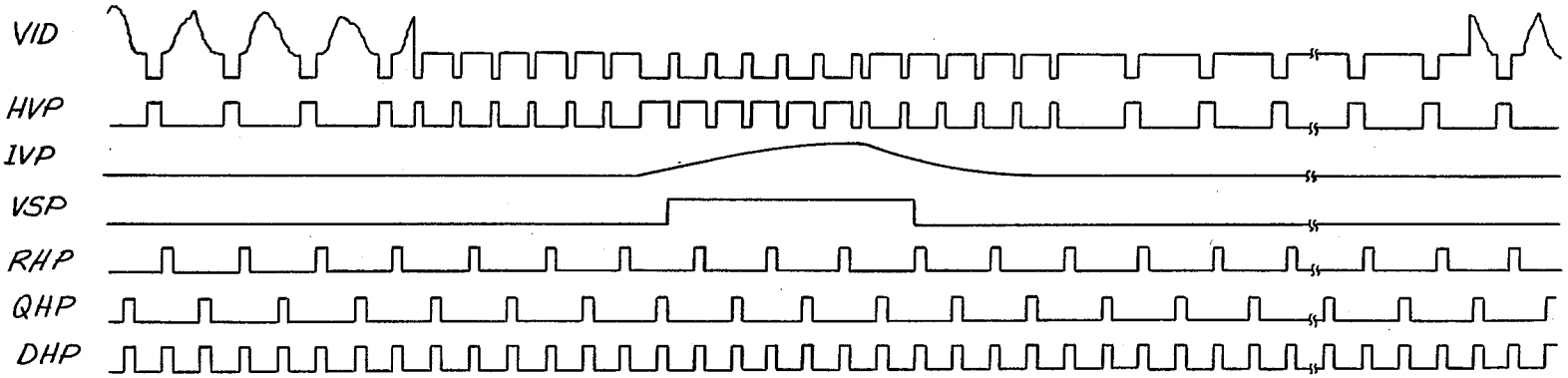

Referring first to FIGS. 8*a* and 8*b*, a series of waveforms of signals relating to the vertical fly-back portion of a video signal is shown. FIG. 8*a* shows the signals associated with the first field, and FIG. 8*b* shows the signals associated with the second field. A composite video signal VID is fed to a synchronizing separator circuit which outputs a synchronizing signal HVP. As is generally known, a single vertical fly-back period consists of an equivalent pulse period of 3H, a cut-in pulse period of 3H and another equivalent pulse period of 3H. The synchronizing signal HVP is applied to an appropriate integrator circuit which delivers an output signal IVP. Output signal IVP is a triangle pulse wave which rises during the cut-in pulse period of the vertical fly-back period of the video signal. Signal IVP is in turn fed to a binary logic circuit, or comparator circuit, and a two-level vertical synchronizing signal VSP is output therefrom. In this embodiment, vertical synchronizing signal VSP has a waveform which is shown in FIG. 8, although the timing of the rising and falling edge of signal VSP may vary with the design criteria of the circuit. The signals described above are well known in the prior art. Signals which are particularly directed to the invention are now described.

A first horizontal synchronizing pulse RHP is generated and is slightly out of phase with the horizontal synchronizing period of synchronizing signal HVP. First horizontal synchronizing signal RHP maintains its periodic nature even during the fly-back period of the video signal. A second horizontal synchronizing signal QHP is produced which is 180° out of phase with first horizontal synchronizing signal RHP. First and second horizontal synchronizing signals RHP and QHP are logically summed to form a double horizontal synchronizing signal DHP.

Figure 9A:
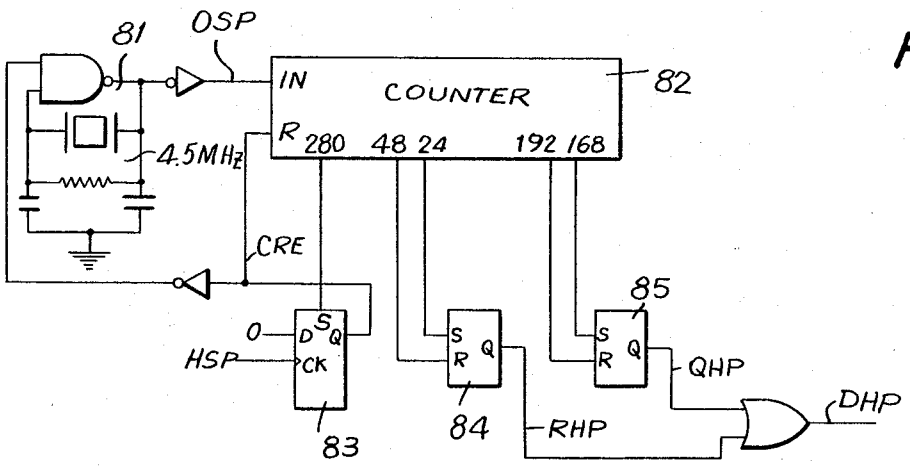
FIG. 9*a* is a circuit diagram of a clock signal forming circuit in accordance with the invention.
Figure 9B:
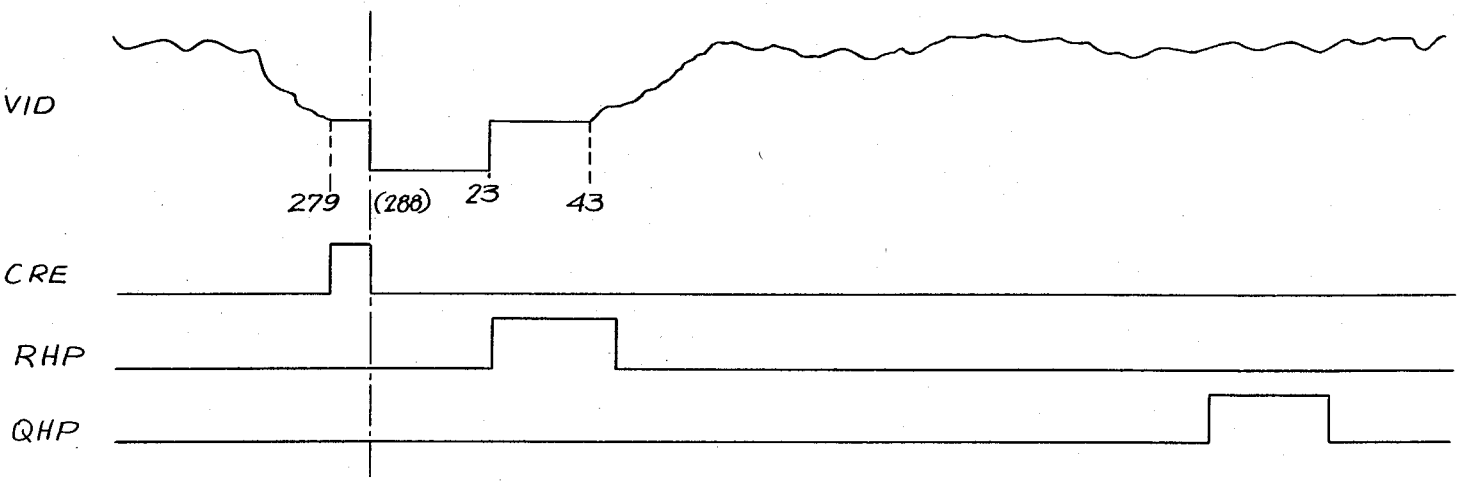
FIG. 9*b* is a timing chart of signals illustrated in the circuit of FIG. 9*a;*

Referring to FIGS. 9*a* and 9*b*, a circuit for forming signals RHP, QHP and DHP is shown. In FIG. 9*a*, an oscillator circit 81 is provided which oscillates at a frequency of approximately 4.5 MHz. This frequency is chosen so that it may be divided down by 288, utilizing counter 82. Hereinafter, the number 288 is selected in order to divide the number of effective scan lines into 220, as an example. However, the dividing rate is adjustable according to circuit design.

Signal HSP is used to clock flip-flop 83, which in turn outputs a signal CRE. Signal CRE is converted through an inverter gate 201 and is fed into oscillator 81. When CRE takes on a value of logical 1, oscillation ceases. During the time of horizontal synchronization, the level of CRE becomes logical 0 and oscillator circuit 81 begins generating a 4.5 MHz signal in synchronicity with the horizontal sync signal. As noted, an output of oscillator 81 is applied to counter 82. Counter 82 is constructed so that it outputs a logical 1 when it counts 24, 38, 168, 192 and 280. Counter 82 may be constructed either by using a binary counter, a shift register or any combination of the two. If the corresponding outputs of multi-stage shift register 53, shown in FIG. 6, are used a each count, then counter 82 is not necessary. Flip-flop 83 is set by the 280 output of counter 82 to generate a logical 1. This output becomes a reset signal CRE for resetting counter 82 to zero wherein the level of output 280 becomes zero. The data input to flip-flop 83 is always kept at logic level 0, so that the level of the output becomes zero at the rising edge of horizontal synchronizing signal HSP. In an equivalent pulse period, or a cut-in pulse period, horizontal synchronizing pulse signal HSP rises at a time of ½H. However, in such a period, output CRE is not set and so CRE may be kept at a level of logical 0.

In this way, counter 82 repeats a count from zero to 280 periodically, regardless of the vertical fly-back period of the video signal. The commencement of counting is synchronized with horizontal synchronization.

A set-reset latch circuit 84 is provided which outputs the first horizontal synchronizing pulse signal RHP, which is set and reset by output 24 and output 48 of counter 82, respectively. Another set-reset latch circuit 85 outputs second horizontal synchronizing signal QHP, which is set and reset by output 168 and output 192 of counter 82, respectively. The first and second horizontal synchronizing signals RHP and QHP are then fed to an OR gate 202 which outputs double horizontal synchronizing pulse signal DHP. Signal QHP lags signal RHP by 144 counts. That is, as one period of counting has a total of 288 counts, and wherein signal QHP is 180° out of phase with signal RHP, signal QHP will lag signal RHP by half the period. Accordingly, the period of double horizontal synchronizing signal DHP is ½H.

Referring now to FIG. 9*b*, a series of timing charts of the signals shown in FIG. 9*a* is illustrated. The numerals provided below composite video signal VID show the content of counter 82 at each respective point and the timing thereof. Using the circuit structures shown in FIG. 9*a*, even if counter 82 is set out of phase by a half period primarily or unexpectedly, after the fly-back period of the video signal, counter 82 will be in a state of being reset until the rise of the synchronizing signal, so that the phase shift is quickly corrected.

Figure 10A:
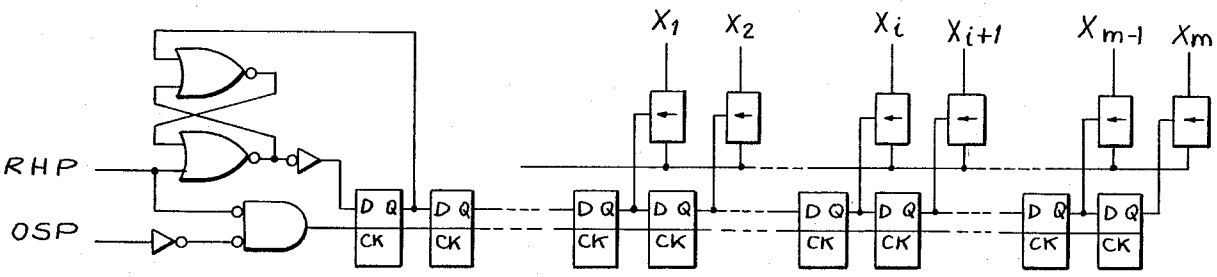
FIGS. 10*a* and 10*b* are circuit diagrams of a driving circuit in accordance with the invention relating to signal electrodes and scanning electrodes, respectively.
Figure 10B:
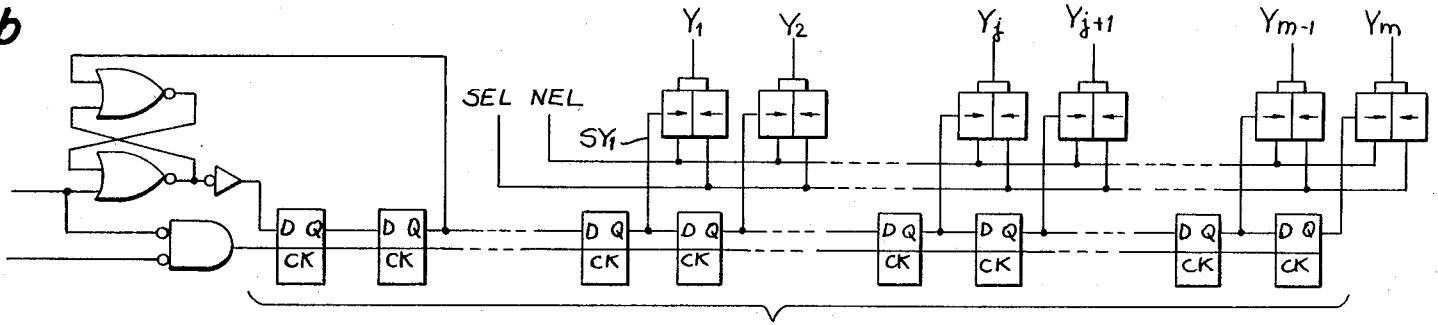

Referring now to FIGS. 10*a* and 10*b*, a driving circuit made in accordance with an embodiment of the invention is shown.

FIG. 10*a* illustrates that portion of the circuit relating to signal electrode signals of the driving circuit assembly, in which signal AVO is the same as that illustrated in FIG. 6, and signals RHP and QHP are the same as those illustrated in FIG. 9. The basic performance of the circuit is generally equal to that shown in FIG. 6, if the picture is to be effectively broken down into 220 parts, "n" being equal to 220.

In FIG. 10*b*, a circuit is illustrated which refers to that part of the circuit generating scanning electrode signals. Signals SEL and NEL correspond to the selected voltage level signal and non-selected voltage level signal shown in FIG. 5. Signals VSP and DHP are again similar to those illustrated in FIG. 9. The performance of the circuit illustrated in FIG. 10 is equal to that of the circuit illustrated in FIG. 5, except as now noted.

The number of picture lines is divided into about twice as many as that provided in the prior art, so that "m" is approximately equal to 480. A clock signal provided to multi-stage shift register 88 is signal DHP from which signals in the vertical fly-back period have been removed. In this way, the clock signal provided to the shift register in this embodiment has a frequency which is twice as high as the clock signal provided in the prior art. Accordingly, the data signals of the first stage of the shift registers remain a logical 1 for two clock periods. The output $SY_j (1 \leqq j \leqq m)$ of each stage is a logical 1 for each 1H. The output of the second stage is utilized as a reset signal to the data input of the first stage.

Figure 10C:
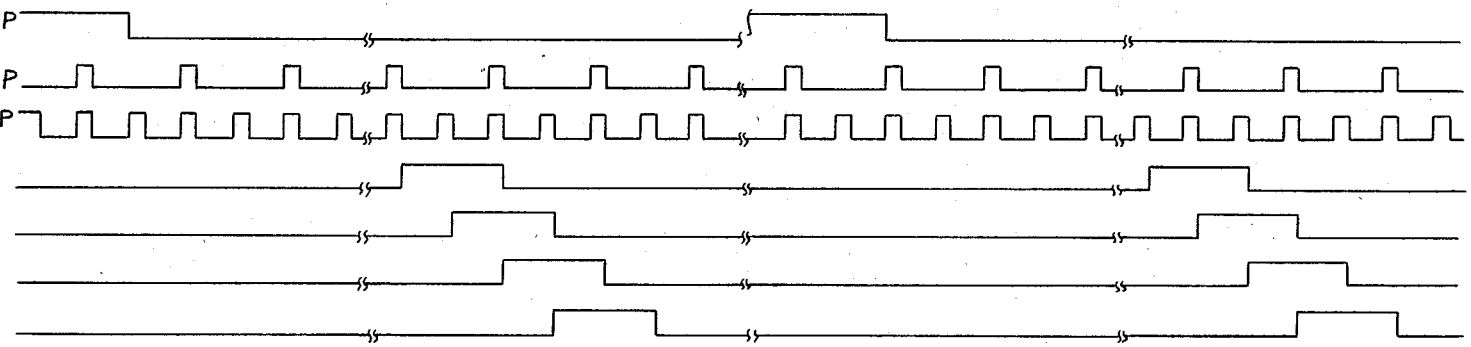
FIG. 10*c* is a timing chart used in the driving circuits of FIGS. 10*a* and 10*b.

Referring now to FIG. 10*c*, a timing chart of signals used in the circuit of FIG. 10*b* is illustrated, in which the left half and right half correspond to the first field and second field, respectively. As can be seen in FIG. 10*c*, each of the vertical synchronizing pulse signals VSP and the first horizontal synchronizing pulse signal RHP is one-half period out of phase between the first and second fields. On the other hand, the phase of the double horizontal synchronizing signal DHP is synchronized and in phase with signal VSP throughout both fields. The output signal of each of the multi-stage shift registers, for example, $SY_1$, $SY_2$, $SY_3$ and $SY_4$, is synchronized with the vertical synchronizing pulse VSP, wherein the period from the fall of VSP to the rise of $SY_j$ is always equal, while the output signals are a half period out of phase with the horizontal synchronizing signal. Thus, as can be seen in the timing charts, the selected scanning electrode to which a scanning period is given in the first field and in the second field is arranged in an alternative relation, and the non-selected scanning electrodes are provided with the scanning period which partly overlaps those of the adjacent scanning electrodes above and below.

The alternating-current signal ACS is utilized in the same manner as that of the prior art, wherein the polarity of signal ACS applied in the first field is opposite of that applied in the second field. In this way, the frame frequency coincides with the alternating-current frequency. In this embodiment, the field frequency and frame frequency, when a standard video signal is applied, are 60 Hz and 30 Hz, respectively. Since 25 Hz is the lower limit of the frequency range of the alternating-current driving signal at which liquid crystal display pictures can be shown without developing a flicker, the liquid crystal display device manufactured in accordance with the present invention is free from the deterioration of quality due to flicker found in the prior art.

The improvement in resolution according to the invention introduced by interlacing scanning lines is now explained.

Figure 11B:
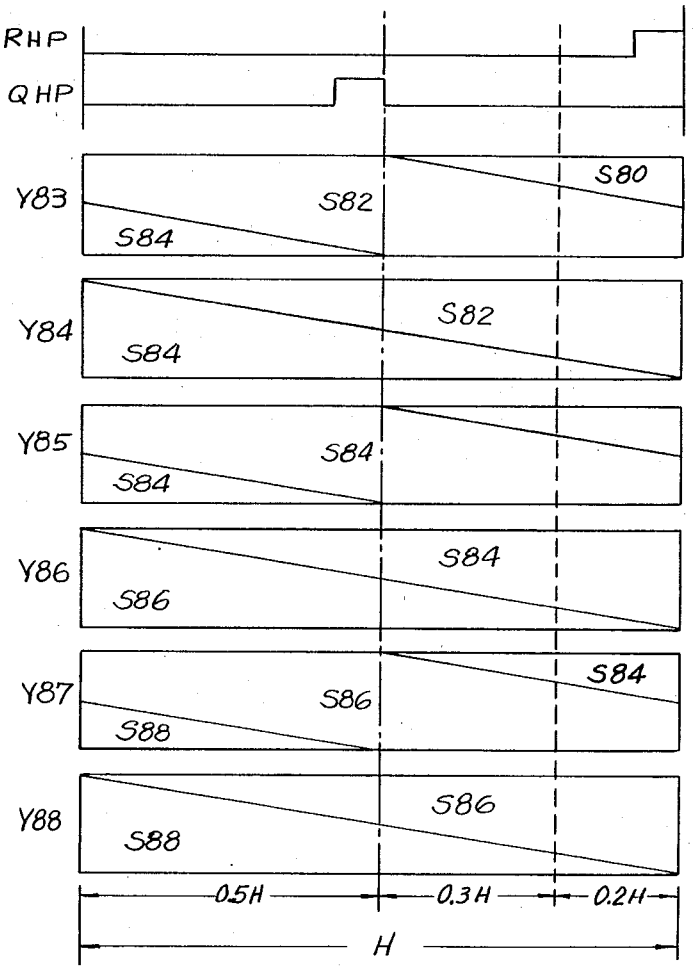
* and FIG. 11 is an illustration explaining the resolution of a device manufactured in accordance with the invention, wherein FIG. 11*a* corresponds to a first field and FIG. 11*b* corresponds to a second field.
Figure 11A:
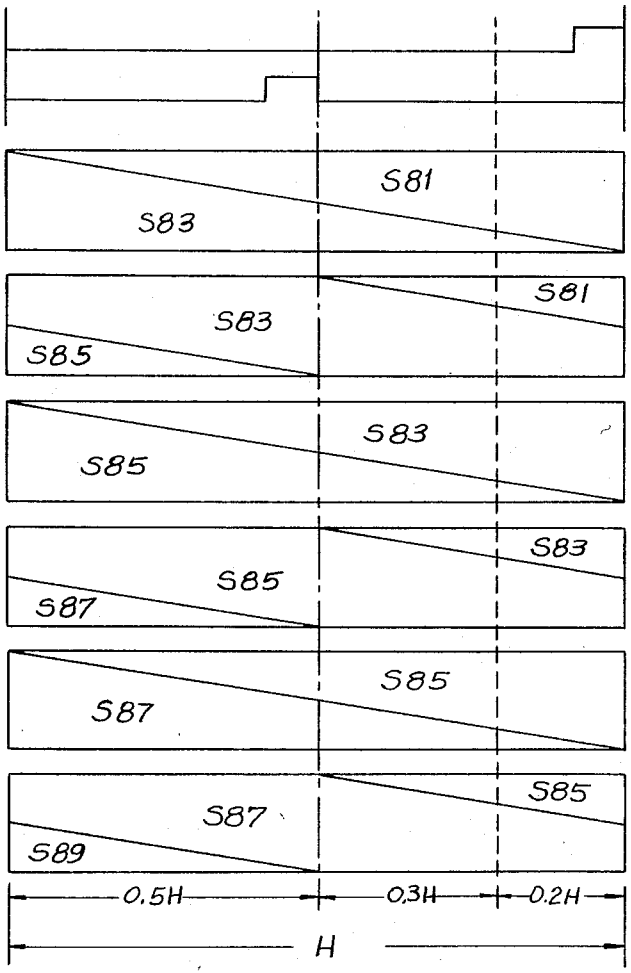

Referring to FIGS. 11*a* and 11*b*, an illustration explaining the resolution of an embodiment of the liquid crystal display device manufactured in accordance with the invention is shown. FIGS. 11*a* and 11*b* show the resolution of first field and second field, respectively. The first and second horizontal synchronizing signals, RHP and QHP, indicate the timing position during a single scan.

To aid in explanation, scanning electrodes $Y_{83}$ through $Y_{88}$ are depicted alone as an example. $S_{80}$ through $S_{89}$ designate the information written on the scanning lines of the corresponding numerals. The chain line illustrated is the middle point of scanning and coincides with the fall of a second horizontal synchronizing signal QHP. The portion to the right of the dashed line corresponds to the horizontal fly-back period, and information thereon is not displayed in normal practice.

As described previously, in the driving method for a liquid crystal video display device utilizing non-linear elements in accordance with this invention, once picture information is written on any line, the information is held on that line even after the corresponding analog switch has been opened, and the information is fully written to the corresponding picture element during that selected period. In FIG. 11, with respect to one rectangle representing one scanning line, the rate of information which may be written to a picture element is shown in the vertical direction.

Referring to $Y_{85}$ in FIG. 11*a*, for example, at the left end, the selected period corresponds to information being written at a ratio of 1:1, and the information $S_{85}$ is written to 100% of the picture element. The more to the right a picture element is, the later the information $S_{85}$ is written, and in turn, the information $S_{83}$ is written instead.

The left end and right end before the dotted line in each rectangle correspond to the left and right ends of the display, respectively. In the center of the display, the picture information $S_{85}$ is written to almost 100% of the picture element on $Y_{86}$. If this point is observed closely, resolution is deteriorated because different information is presented on the same line. In practice, however, because the rate of the mixture of information is constant and the gradient of scanning lines coincides with the degree of mixture of information, no serious visual problems occur.

In the second field, as shown in FIG. 11*b*, the scanning period is defined in a different manner from that of the first field. Once again with respect to electrode line $Y_{85}$, the scanning period for information $S_{84}$ and information $S_{86}$ is provided for the first half and second half, respectively. Accordingly, to the picture elements at the left end of the display, information $S_{84}$ is written for about 50% at first and then information $S_{86}$ starts to be written. To the element a little left of center, the information $S_{84}$ is fully written before the information $S_{86}$ is written; to the element a little right of center, after information $S_{82}$ is written slightly, information $S_{84}$ is fully written. To the element at the right end of the display, information $S_{82}$ is written for about 30% of the time, and then the writing of the information $S_{84}$ begins. The condition of information writing on other electrodes is apparent from the drawings.

As explained before, the conditions supplied in FIGS. 11*a* and 11*b* repeat alternately along with a change in polarity. In the case where the moving picture information is written, the information is read and displayed at every moment and the quality of the display is maintained at a high level. In addition, even if still picture information is written, the resolution of the display is not deteriorated. This occurs because the picture information written on the scanning electrode line to which the scanning period is given, overlapping those of the preceding and following scanning electrode lines, is considered to be the average of the information on the two adjacent scanning lines. For example, the average of the informations $S_{81}$ and $S_{83}$ is defined as $S_{82'}$. The picture information written on the picture element in the center of the picture, that is, FIG. 11*a* top to bottom, would be considered $S_{82'}$, $S_{83}$, $S_{84'}$, $S_{85}$, $S_{86'}$ and $S_{87}$, and referring to FIG. 11*b*, top to bottom the information would be $S_{82}$, $S_{83'}$, $S_{84}$, $S_{85'}$, $S_{86}$ and $S_{87'}$. Thus, even if the still picture information is written, resolution is not deteriorated.

Moreover, in a liquid crystal video receiver device manufactured in accordance with the invention, the liquid crystal is free from the aberration of polarity caused by alternating driving current, which has been a serious problem of degrading liquid crystal material in the prior art.

Thus, an explained above, and in accordance with the present invention, a high-quality display is obtained using a liquid crystal video receiver utilizing non-linear elements. Furthermore, the driving method for the device can be manufactured without the need for any complicated circuits and may be made of low-cost parts.

It will thus be seen that the objects set forth above, and those made apparent from the preceding description, are efficiently attained, and since certain changes may be made in the above construction without departing from the spirit and scope of the invention, it is intended that all matter contained in the above description or shown in the accompanying drawings shall be interpreted as illustrative, and not in a limiting sense.

It is also to be understood that the following claims are intended to cover all of the generic and specific features of the invention herein described and all statements of the scope of the invention which, as a matter of language, might be said to fall therebetween.

What is claimed is:

1. A liquid crystal video display device for receiving a video signal generated in accordance with an interlace method comprising:

driving means for receiving a video signal and generating scanning signals and video information signals in response to said video signals;

liquid crystal display means; and coupling means for coupling said driving means to said display means, said display means including:

a first substrate formed with a plurality of scanning electrodes, said scanning electrodes being positioned substantially parallel to the direction of video signal scanning;

a second substrate formed with a plurality of signal electrodes, said signal electrodes being positioned substantially perpendicular to the direction of said scanning electrodes, wherein picture elements are defined at the intersection of each of said scanning electrodes and signal electrodes, said scanning electrodes being grouped into at least two interlaced sets;

liquid crystal material held between said first and second substrates;

a plurality of non-linear elements, at least one of said elements being provided at each intersection of said scanning electrodes and signal electrodes, said driving means providing first scanning signals to a first set of scanning electrodes, said first scanning signals being shifted sequentially among the scanning electrodes of said first set at least once each scanning period; providing second scanning signals to a second set of scanning electrodes, said second scanning signals being shifted among the scanning electrodes of said second set so that the second scanning signals are applied to the scanning electrodes of said second set adjacent a driven scanning electrode of said first set, said second scanning signals partly overlapping the scanning signal applied to said driven scanning electrode; and providing a video information signal to the signal electrodes during a period which is a fraction of a scanning period whereby a non-interlace type display in which each of the picture elements is driven each scanning period is produced.

2. The liquid crystal video display device, as claimed in claim 1, wherein said interlacing method is of the two field-one frame type, said first and second sets of scanning electrodes each defining a field, so that two passes over the entire display are necessary in order to create one picture.

3. The liquid crystal video display device, as claimed in claim 2, wherein the scanning electrodes of the first set are in alternating alignment with the scanning electrodes of the second set.

4. The liquid crystal video display device, as claimed in claim 3, wherein said first scanning signals are applied sequentially to said first set of scanning electrodes and then to said second set of scanning electrodes, said second scanning signals being applied to said first set of scanning electrodes when said first scanning signals are applied to said second set of electrodes, so that the second scanning signals applied to the scanning electrodes of the first set adjacent a driven scanning electrode of said second set partly overlap the scanning signal applied to said driven scanning electrode of said second set.

5. The liquid crystal video display device, as claimed in claim 1, further including reversing means wherein the scanning signals provided to said scanning electrode and said video information signals provided to said signal electrodes are reversed in polarity every field by said reversing means.

6. The liquid crystal video display device, as claimed in claim 1, wherein said non-linear elements are Metal-Insulator-Metal elements.

7. The liquid crystal video display device, as claimed in claim 1, wherein said non-linear elements are varistor elements.

8. The liquid crystal video display device, as claimed in claim 1, wherein said non-linear elements are discharge tube elements.

9. The liquid crystal video display device, as claimed in claim 1, wherein said plurality of scanning electrodes are 480 in number.

10. The liquid crystal video display device, as claimed in claim 1, wherein said video signal includes a combined horizontal and vertical synchronizing pulse, and said driving means is adapted to generate a first horizontal synchronizing signal, a second horizontal synchronizing signal and a double horizontal synchronizing signal, said double horizontal synchronizing signal being the logical summation of said first horizontal synchronizing signal and said second horizontal synchronizing signal, said first horizontal synchronizing signal being out of phase with the combined horizontal and vertical synchronizing pulse of said video signal.

11. The liquid crystal video display device, as claimed in claim 10, wherein said driving means further includes oscillator means; counter means coupled to said oscillator means for receiving as an input the output of said oscillator means; and a plurality of flip-flop means, each of said flip-flop means having its input coupled to an output of said counter means, said flip-flop means being further adapted to generate said first horizontal synchronizing signal and second horizontal synchronizing signal.

12. The liquid crystal video display device as claimed in claim 11, wherein said counter means is adapted to output a logical one when it has made 24, 28, 168, 192 and 280 counts, said first horizontal synchronizing pulse flip-flop means receiving said 24 count output and said 48 count output and said second horizontal synchronizing pulse flip-flop receiving said 168 and said 192 count output, said 280 count output being further coupled to said video signal horizontal synchronizing pulse for resetting said counter means after 280 counts.

13. The liquid crystal video display device as claimed in claim 1 wherein the liquid crystal material is a twisted nematic liquid crystal.

* * * * *